US008113367B2

(12) United States Patent
Pawlick et al.

(10) Patent No.: US 8,113,367 B2
(45) Date of Patent: Feb. 14, 2012

(54) NON-REMOVABLE CLOSURE HAVING A DISPENSING APERTURE EXTENDING THERETHROUGH

(75) Inventors: Adam Pawlick, Omaha, NE (US); Doug Czajkowski, Omaha, NE (US)

(73) Assignee: Con Agra Foods RDM, Inc., Omaha, NE (US)

( * ) Notice: Subject to any disclaimer, the term of this patent is extended or adjusted under 35 U.S.C. 154(b) by 898 days.

(21) Appl. No.: 11/708,505

(22) Filed: Feb. 20, 2007

(65) Prior Publication Data

US 2008/0197099 A1 Aug. 21, 2008

(51) Int. Cl.
*B65D 39/00* (2006.01)
*B65D 47/02* (2006.01)
*B65D 49/00* (2006.01)

(52) U.S. Cl. ..... 215/263; 215/14; 215/45; 215/232; 215/236; 215/310; 215/346; 215/347; 215/349; 220/256.1; 220/259.1; 220/849; 222/556

(58) Field of Classification Search ..... 215/14, 215/24, 28, 45, 49, 53, 229, 232, 235, 236, 215/243, 263, 310, 341, 346, 347, 349, 556; 220/256.1, 259.1, 267, 268, 277, 849; 222/556
See application file for complete search history.

(56) References Cited

U.S. PATENT DOCUMENTS

| | | | | |
|---|---|---|---|---|
| 888,132 A | | 5/1908 | Wadsworth | |
| 2,013,605 A | * | 9/1935 | Greenison | 215/252 |
| 2,173,570 A | | 9/1939 | Jesnig | |
| 2,438,671 A | * | 3/1948 | Marana | 215/347 |
| 2,501,849 A | * | 3/1950 | Krebs | 215/261 |
| 2,620,939 A | * | 12/1952 | Weisgerber | 215/347 |
| 2,715,474 A | * | 8/1955 | Phillips | 215/347 |
| 2,718,323 A | * | 9/1955 | Kennedy | 215/347 |
| 2,748,969 A | * | 6/1956 | Leary | 215/329 |
| 2,937,481 A | * | 5/1960 | Palmer | 53/471 |

(Continued)

FOREIGN PATENT DOCUMENTS

WO WO 98/04474 2/1998

(Continued)

OTHER PUBLICATIONS

2004 Foodservice Grand Prix Winner's Showcase, Canadian Council of Grocery Distributors, IFDA, pp. 1-15.

*Primary Examiner* — J. Gregory Pickett
*Assistant Examiner* — Ned A Walker
(74) *Attorney, Agent, or Firm* — Advent; Ryan T. Grace

(57) ABSTRACT

The present invention is a non-removable closure.

A non-removable closure in accordance with the present invention may comprise (a) a first sealant layer; (b) a sealant interface layer; and (c) a second sealant layer.

A non-refillable container for flowable materials in accordance with the present invention may comprise: (a) a cap; (b) a first sealant layer; (c) a sealant interface layer; (d) a second sealant layer; and (e) a flowable material receptacle.

A method for manufacturing a non-removable bottle closure in accordance with the present invention may comprise the steps: (a) disposing a first sealant layer on a first surface of a sealant interface layer; (b) disposing a second sealant layer on a second surface of the sealant interface layer; (c) adhering the first sealant layer to a cap; and (d) adhering the second sealant layer to a receptacle mouth.

20 Claims, 3 Drawing Sheets

U.S. PATENT DOCUMENTS 3,025,988 A 3/1962 Williams
3,189,206 A 6/1965 Miller
3,319,836 A 5/1967 Culbit
3,389,839 A 6/1968 Williams
3,595,419 A * 7/1971 Dukess ..... 215/329
3,632,004 A * 1/1972 Grimes et al. ..... 215/232
3,819,460 A * 6/1974 Dukess ..... 428/66.4
3,917,100 A * 11/1975 Dukess ..... 215/329
3,951,293 A * 4/1976 Schulz ..... 215/261
3,960,288 A * 6/1976 Phillips ..... 215/329
3,963,845 A * 6/1976 Dukess ..... 428/66.4
3,973,690 A * 8/1976 Schneider ..... 215/329
3,976,217 A * 8/1976 Dukess ..... 215/329
4,089,434 A * 5/1978 Tagalakis et al. ..... 215/260
4,121,728 A * 10/1978 Tagalakis et al. ..... 215/260
4,279,350 A * 7/1981 King ..... 215/228
4,355,729 A 10/1982 Maguire
4,457,440 A * 7/1984 Dukess ..... 215/347
4,545,495 A * 10/1985 Kinsley ..... 215/235
4,564,117 A * 1/1986 Herbert ..... 215/329
4,576,297 A * 3/1986 Larson ..... 215/250
4,579,240 A * 4/1986 Ou-Yang ..... 215/230
4,588,099 A * 5/1986 Diez ..... 215/232
4,625,875 A * 12/1986 Carr et al. ..... 215/232
4,666,052 A * 5/1987 Ou-Yang ..... 215/230
4,684,554 A * 8/1987 Ou-Yang ..... 428/34.2
4,687,113 A * 8/1987 Reeve ..... 215/230
4,723,678 A * 2/1988 Kollen et al. ..... 215/347
4,733,786 A * 3/1988 Emslander ..... 215/230
4,756,437 A * 7/1988 Rossi-Mossuti ..... 215/230
4,765,499 A * 8/1988 von Reis et al. ..... 215/261
4,773,552 A * 9/1988 Boege et al. ..... 215/247
4,778,698 A * 10/1988 Ou-Yang ..... 428/34.4
4,789,074 A * 12/1988 Han ..... 215/347
4,815,618 A * 3/1989 Gach ..... 215/232
4,818,577 A * 4/1989 Ou-Yang ..... 428/36.5
4,835,035 A * 5/1989 Bayer ..... 428/184
4,863,051 A * 9/1989 Eibner et al. ..... 215/261
4,917,949 A * 4/1990 Yousif ..... 428/349
4,930,646 A * 6/1990 Emslander ..... 215/232
4,935,273 A * 6/1990 Ou-Yang ..... 428/35.7
4,974,757 A * 12/1990 Brotz ..... 222/562
4,977,003 A * 12/1990 Brown et al. ..... 428/35.5
4,993,606 A * 2/1991 Bolen et al. ..... 222/546
5,057,365 A * 10/1991 Finkelstein et al. ..... 428/344
5,143,763 A * 9/1992 Yamada et al. ..... 428/36.2
5,147,057 A 9/1992 Marshall et al.
5,197,618 A * 3/1993 Goth ..... 215/232
5,230,427 A * 7/1993 Betts et al. ..... 206/213.1
5,234,117 A * 8/1993 Garvin ..... 215/11.4
5,289,932 A * 3/1994 Dimeo et al. ..... 215/349
5,360,127 A 11/1994 Barriac et al.
5,372,268 A * 12/1994 Han ..... 215/232
5,381,913 A * 1/1995 Peeters ..... 215/232
5,388,731 A * 2/1995 Mengeu et al. ..... 222/545
5,395,006 A * 3/1995 Verma ..... 220/371
5,437,383 A * 8/1995 Stull ..... 215/235
5,482,591 A * 1/1996 Reo ..... 156/306.6
5,513,781 A * 5/1996 Ullrich et al. ..... 222/565
5,531,341 A * 7/1996 Shlisky ..... 215/308
5,579,936 A * 12/1996 Costa et al. ..... 215/261
5,598,940 A * 2/1997 Finkelstein et al. ..... 215/348
5,601,200 A * 2/1997 Finkelstein et al. ..... 215/348
5,615,789 A * 4/1997 Finkelstein et al. ..... 215/348
5,690,241 A 11/1997 Montgomery
5,730,306 A * 3/1998 Costa et al. ..... 215/261
5,756,178 A * 5/1998 Obadia ..... 428/66.4
5,860,544 A * 1/1999 Brucker ..... 215/232
5,871,112 A * 2/1999 Giles et al. ..... 215/347
5,934,494 A * 8/1999 Takahashi et al. ..... 215/347
6,041,953 A * 3/2000 Goodall ..... 215/354
6,068,900 A * 5/2000 Kohn et al. ..... 428/35.7
6,082,568 A * 7/2000 Flanagan ..... 215/257
6,139,931 A * 10/2000 Finkelstein et al. ..... 428/36.6
6,202,870 B1 * 3/2001 Pearce ..... 215/307
6,220,466 B1 * 4/2001 Hayes et al. ..... 215/276
6,312,776 B1 * 11/2001 Finkelstein et al. ..... 428/36.6
6,315,145 B1 * 11/2001 Fask et al. ..... 220/254.1
6,378,715 B1 * 4/2002 Finkelstein et al. ..... 215/341
6,602,309 B2 * 8/2003 Vizulis et al. ..... 55/385.4
6,648,853 B1 * 11/2003 McEntee ..... 604/88
6,983,857 B2 * 1/2006 Miller et al. ..... 215/270
7,168,581 B2 * 1/2007 Robinson et al. ..... 215/349
7,185,780 B2 * 3/2007 Nomula ..... 220/359.3
7,357,266 B2 * 4/2008 Giblin et al. ..... 215/261
7,637,390 B2 * 12/2009 Bocola ..... 220/849
7,648,764 B2 * 1/2010 Yousif ..... 428/346
2003/0121877 A1 * 7/2003 Brozell et al. ..... 215/220
2003/0189023 A1 * 10/2003 Gonzalez ..... 215/260
2004/0055992 A1 * 3/2004 Robinson et al. ..... 215/347
2004/0262253 A1 * 12/2004 Miller et al. ..... 215/270
2005/0029270 A1 * 2/2005 Marshall ..... 220/705
2005/0127082 A1 * 6/2005 Nomula ..... 220/796
2005/0167388 A1 * 8/2005 Bocola ..... 215/235
2006/0124577 A1 * 6/2006 Ross et al. ..... 215/347
2006/0124578 A1 * 6/2006 Yousif et al. ..... 215/347
2007/0007229 A1 * 1/2007 Yousif ..... 215/232

FOREIGN PATENT DOCUMENTS

WO WO 2007/112569 10/2007

* cited by examiner

NON-REMOVABLE CLOSURE HAVING A DISPENSING APERTURE EXTENDING THERETHROUGH

FIELD OF THE INVENTION

The present invention relates to a tamper-resistant device or a closure assembly adapted to be applied to a mouth of a container, for example, a neck of a bottle. More particularly, the invention particularly, the invention relates to an adhesive closure mechanism wherein the closure may not be removed from a container once it has been applied.

BACKGROUND OF THE INVENTION

In today's service industries, the possibility exists that proprietors may purchase premium products having distinctive packaging and may refill the contents of that packaging with a less expensive substitute product having characteristics and quality which may be inferior to the premium product while passing off the product as the genuine premium product.

For example, a container, such as a bottle intended to contain a flowable liquid or gel (e.g., condiments, alcoholic beverages, personal products, motor oils) may be re-filled with a replacement quantity of another liquid where the characteristics and quality of which differ from the original contents. While a single-piece molded bottle design may effectively inhibit refilling the bottle with an inferior product, it will likewise inhibit the initial filling by the manufacturer. Therefore, it is desirable to affix a non-removable closure following an initial filling of a bottle.

Attempts to provide closures which make refilling difficult are not always effective against determined tampering. While it is considered advantageous to utilize a tamper-indicating means which provides evidence that the bottle, its cap and/or its contents are in their original conditions, if the bottle is re-sealable with a substitute cap or closure, there may be little to indicate to a purchaser or consumer that the bottle has been tampered with and that the contents may be inferior to the original contents.

Furthermore, there is a need for simple designs of closure assemblies allowing easy and reliable manufacture, assembly and fitting to bottle necks. Such simplicity has been somewhat lacking in previous closure designs. Currently, non-removable closures incorporate mutual ratcheting mechanisms between the closure and the bottle. Such mechanisms require custom closure and bottle tooling which can be expensive.

Therefore, it would be desirable to provide a non-removable bottle closure mechanism where existing removable bottle closure technology may be adapted to become non-removable.

SUMMARY OF THE INVENTION

Accordingly, the present invention is directed to a non-removable bottle closure, a non-refillable bottle incorporating a non-removable bottle closure and method for manufacturing a non-removable bottle closure.

In an embodiment of the invention, a non-removable bottle closure apparatus may comprise: (a) a first sealant layer; (b) a sealant interface layer; and (c) a second sealant layer.

In a further embodiment of the invention, a non-refillable bottle may comprise: (a) a bottle cap; (b) a first sealant layer; (c) a sealant interface layer; (d) a second sealant layer; and (e) a bottle.

In still a further embodiment of the invention, a method for manufacturing a non-removable bottle closure may comprise the steps: (a) disposing a first sealant layer on a first surface of a sealant interface layer; (b) disposing a second sealant layer on a second surface of the sealant interface layer; (c) adhering the first sealant layer to a bottle cap; and (d) adhering the second sealant layer to a bottle mouth.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Figure 1A:
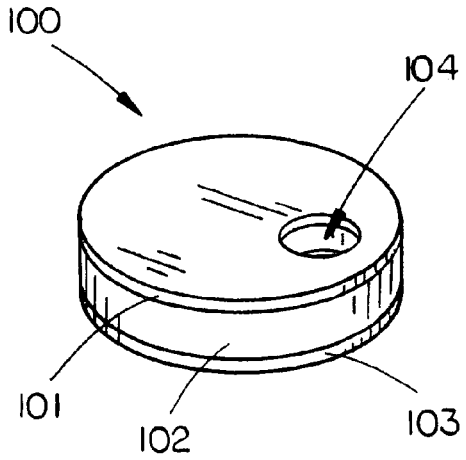
FIG. 1A depicts a non-removable bottle closure mechanism in accordance with an embodiment of the present invention.

The following discussion is presented to enable a person skilled in the art to make and use the present teachings. Various modifications to the illustrated embodiments will be readily apparent to those skilled in the art, and the generic principles herein may be applied to other embodiments and applications without departing from the present teachings. Thus, the present teachings are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of the present teachings. Skilled artisans will recognize the examples provided herein have many useful alternatives and fall within the scope of the present teachings.

Reference will now be made, in detail, to presently preferred embodiments of the invention. Additional details of the invention are provided in the examples illustrated in the accompanying drawings.

Referring to FIG. 1A, a non-removable bottle closure 100 in accordance with the present invention is disclosed. The bottle closure 100 may comprise a first sealant layer 101, a sealant interface layer 102 and a second sealant layer 103. The sealant interface layer 102 may be constructed from any number of rigid, food safe compositions having adequate shear strength characteristics such that a consumer of the product is unable to remove the cap without undue effort. The composition of the sealant interface layer 102 may including papers, foils, and plastics. Possible plastics may include polypropylene, high or low-density polyethylene (HDPE and LDPE respectively), high-impact polystyrene, and numerous other food-safe plastics compositions common to the packaging arts. The sealant interface layer 102 may also possess anti-microbial characteristics so as to better preserve the product contained within a bottle employing the inventive closure 100.

The identity of the first sealant layer 101 and the second sealant layer 103 may be specified based upon the composition of the sealant interface layer 102 and the compositions of an associated bottle cap and bottle (not shown). Certain sealant types are conducive to bonding selected materials to one another.

For example, when using a polyethylene bottle cap, interface layer 102 and bottle, polyethylene-type sealant layers 101 and 103 may be used. Such polyethylene-type sealant layers may include common polyethylene, LDPE or HDPE. In further embodiments, the first sealant layer 101 and second sealant layer 103 may have different compositions. For example, if HDPE bottle is utilized in combination with a polypropylene (PP) lid, the first sealant layer 101 could be selected from PE, LDPE, HDPE or other polyethylene analog while the second sealant layer is selected from the polypropylene analogs.

To enhance the sealant characteristics of the non-removable bottle closure 100, surface treatments may be applied to the surfaces of the sealant interface layer. Such surface treatments may include abrading, roughening, acid etching, flame treatments, plasma treatment, thermal treatment, and/or primer applications.

Figure 1B:
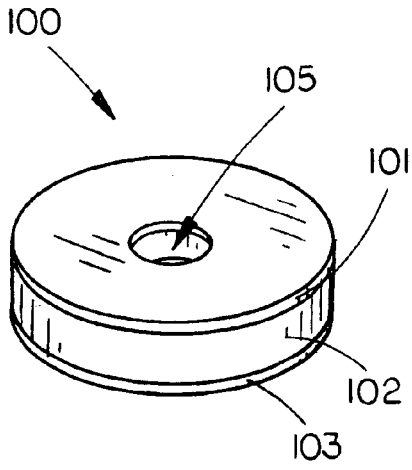
FIG. 1B depicts a non-removable bottle closure mechanism in accordance with an embodiment of the present invention

The bottle closure 100 may also comprise a dispensing aperture 104. The dispensing aperture 104 may be formed from free-space voids disposed in the first sealant layer 101, the sealant interface layer 102 and the second sealant layer 103. The dispensing aperture 104 may provide a conduit for the transfer of a pourable liquid out of a bottle which has been sealed by the bottle closure 100. In one embodiment, the dispensing aperture 104 may be located towards the periphery of the bottle closure 100. Referring to FIG. 1B, in a further embodiment of the invention, a dispensing aperture 105 may be centrally located within the bottle closure 100.

Figure 2A:
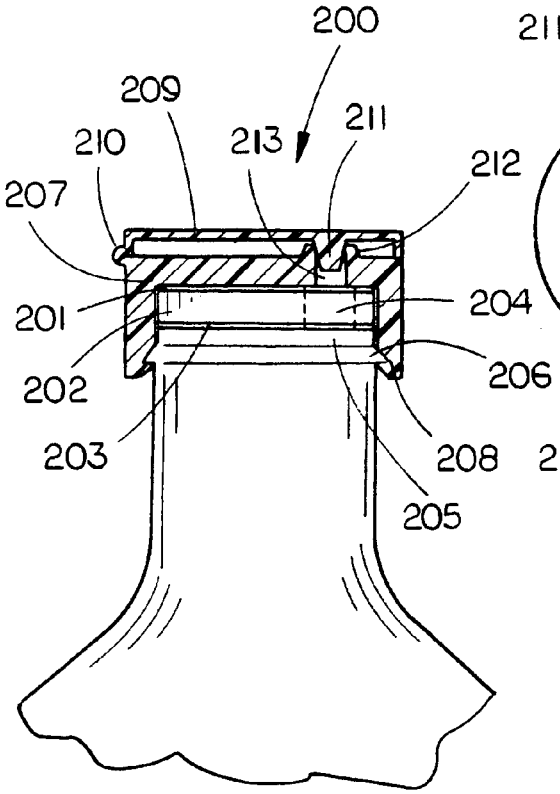
FIG. 2A depicts a cross-sectional view of a non-refillable bottle incorporating a non-removable closure in accordance with an embodiment of the present invention.

Referring to FIG. 2A, a cross-sectional view of a non-refillable bottle 200 incorporating a non-removable closure in accordance with an embodiment of the present invention is disclosed. The non-refillable bottle 200 may comprise a first sealant layer 201, a sealant interface layer 202, and a second sealant layer 203. The first sealant layer 201, sealant interface layer 202 and second sealant layer 203 may each comprise substantially circular apertures which are cooperatively aligned so as to form a dispensing aperture 204.

The sealant interface layer 202 may be bonded to a bottle mouth 205 via the second sealant layer 203. Similarly, the sealant interface layer 202 may be bonded to a bottle lid 207. The bonding process may include induction sealing methods commonly known in the art. The bonding process serves to conjoin the bottle lid 207, sealant interface layer 202, and bottle mouth 205 so as to create a non-refillable bottle 200.

In order to provide an additional mechanism for securing the bottle lid 207 to the bottle mouth 205, a flange 206 may be disposed about the bottle mouth 205. The flange 206 may cooperate with a recessed groove 208 disposed in the bottle lid 207 to form a snap-lock mechanism further preventing removal of the bottle closure 200. It should be recognized by one skilled in the art that the arrangement of the flange 206 and recessed grove 208 could easily be reversed to provide a flange disposed about the interior of the bottle lid 207 and a recessed grove disposed about the bottle mouth 205.

Figure 2B:
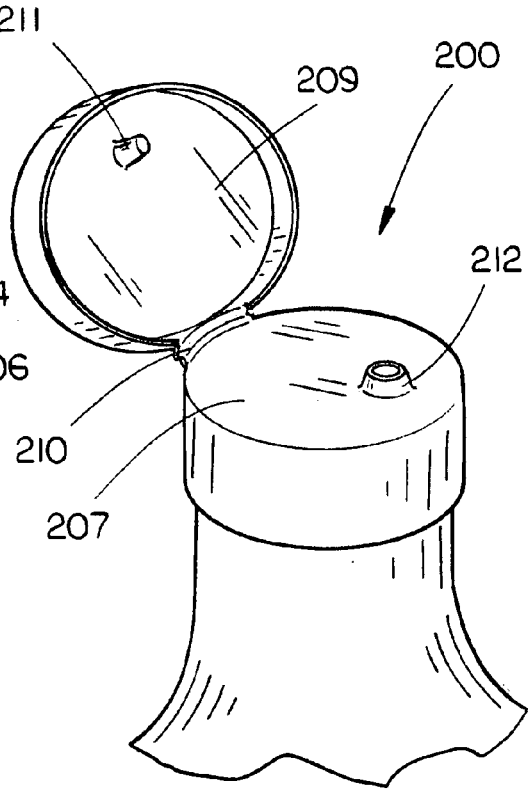
FIG. 2B depicts an axonometric view of the non-refillable bottle of FIG. 2A.

The bottle lid 207 may further comprise a flip-top closure 209 connected to the bottle lid 207 via hinge mechanism 210. The flip-top closure 209 serves to provide access to the substance contained within the bottle following its closure using the bottle closure 200. The flip-top closure 209 and bottle lid 207 may comprise a projection 211 and aperture 212, respectively, for closing off the flow from the interior of the bottle through aperture 204 and lid aperture 213. In FIG. 2*b*, an axonometric view of the non-removable bottle closure 200 is also presented.

In still a further embodiment of the invention, the sealant interface layer 202 and second sealant layer 203 are not used. Only the first sealant layer 201 is disposed between the bottle lid 207 and the bottle mouth rim surface 205.

Figure 5:
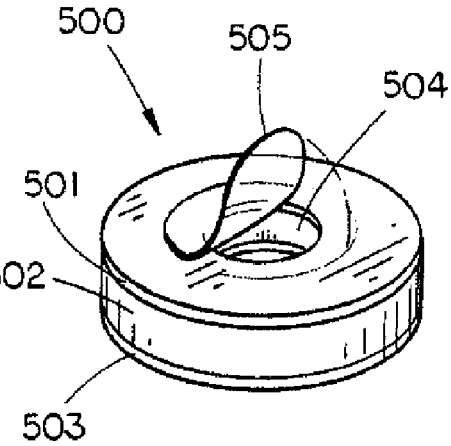
FIG. 5 depicts an axonometric view of a non-removable bottle closure mechanism in accordance with an embodiment of the present invention.

Referring to FIG. 5, a bottle closure 500 according to the present invention may further comprise a freshness seal 505 in association with the first sealant layer 501, sealant interface layer 502, and second sealant layer 503. The freshness seal 505 serves to provide a hermetic seal over dispensing aperture 504 following the initial filling of a bottle and its first use. A bottle closure 500 may be incorporated with a bottle lid 207 such as that presented in FIG. 2. Prior to an initial use, the freshness seal 505 may be ruptured via a sharp object or other mechanism through bottle lid aperture 212 so as to provide access to dispensing aperture 204.

Figure 3A:
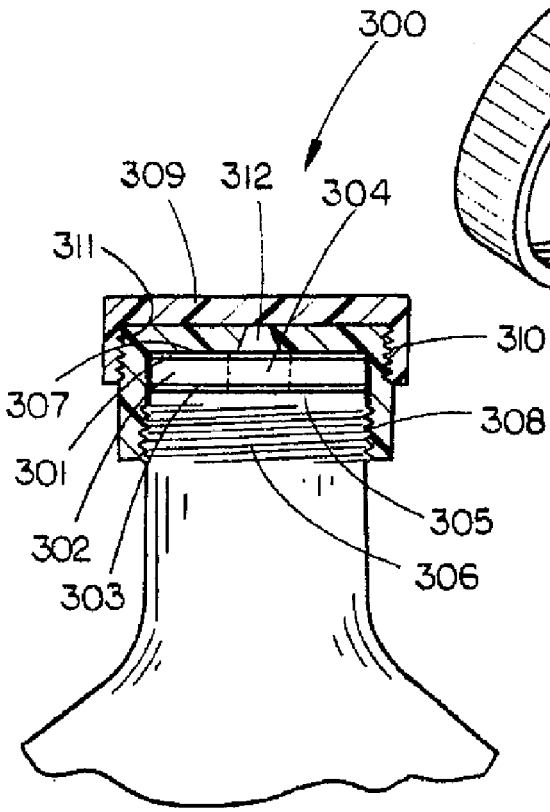
FIG. 3A depicts a cross-sectional view of a non-refillable bottle incorporating a non-removable closure in accordance with an embodiment of the present invention.

Referring to FIG. 3A, a cross-sectional view of a non-refillable bottle 300 incorporating a non-removable closure in accordance with an embodiment of the present invention is disclosed. The non-refillable bottle 300 may comprise a first sealant layer 301, a sealant interface layer 302, and a second sealant layer 303. The first sealant layer 301, sealant interface layer 302 and second sealant layer 303 may each comprise substantially circular apertures which are cooperatively aligned so as to form a dispensing aperture 304.

The sealant interface layer 302 may be bonded to a bottle mouth 305 via the second sealant layer 303. Similarly, the sealant interface layer 302 may be bonded to a bottle lid 307. The bonding process may include induction sealing methods commonly known in the art. The bonding process serves to conjoin the bottle lid 307, sealant interface layer 302, and bottle mouth 305 so as to create a non-refillable bottle 300.

In order to provide an additional mechanism for securing the bottle lid 307 to the bottle mouth 305, threading 306 may be disposed about the bottle mouth 305. The threading 306 may cooperate with a reversed threading 308 disposed in the bottle lid 307 to form a mutual-threading mechanism further preventing removal of the bottle closure 200.

The bottle closure 300 may further comprise a screw-top closure 309 where threading 311 on the interior of the screw-top closure 309 cooperates with threading 310 on the exterior of the bottle lid 307 to secure the screw-top closure 309 to the bottle closure 300. The screw-top closure 309 serves to provide access to the substance contained within the bottle following its closure using the bottle closure 300. The bottle lid 307 may comprise a lid aperture 312, which permits flow from the interior of the bottle through aperture 304 when the screw-top closure 309 is removed.

In still a further embodiment of the invention, the sealant interface layer 302 and second sealant layer 303 are not used. Only the first sealant layer 301 is disposed between the bottle lid 307 and the bottle mouth 305.

Figure 3B:
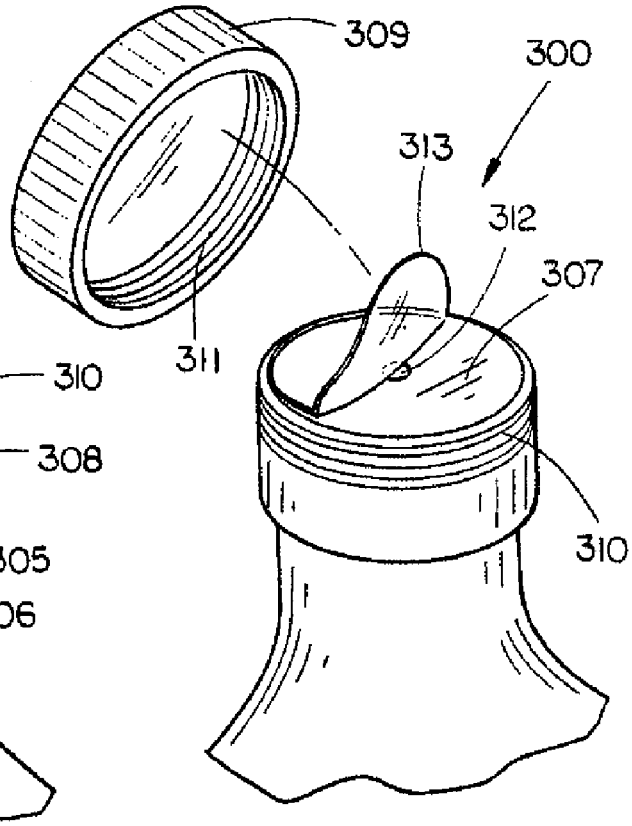
FIG. 3B depicts an axonometric view of the non-refillable bottle of FIG. 3A.

In FIG. 3B, an axonometric view of a non-removable bottle closure 300 is presented. The non-removable bottle closure may further comprise a freshness-seal 313 disposed over the bottle lid 307. The freshness seal 313 serves to provide a hermetic seal over the lid aperture 312 and dispensing aperture 304 following the initial filling of a bottle and its first use. The freshness-seal 313 may be removed prior to the first use by peeling it away from the bottle lid 307.

Figure 4:
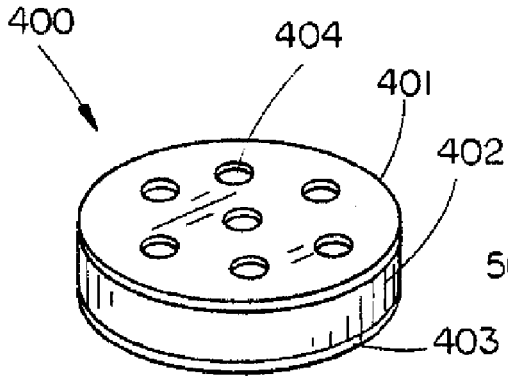
FIG. 4 depicts an axonometric view of a non-removable bottle closure mechanism in accordance with an embodiment of the present invention.

In FIG. 4, a bottle closure 400 in accordance with an embodiment of the invention is presented. A plurality of dispensing apertures 404 may be disposed within the first sealant layer 401, sealant interface layer 402, and second sealant interface layer 403 to provide a conduit for the flow from the interior of the bottle. Use of multiple dispensing apertures 404 allows for increased flow (as from a larger single-aperture arrangement) while continuing to inhibit refilling the bottle.

In further embodiments, the non-removable bottle closures of FIGS. 1-5 may be incorporated with other flowable material containers including squeezable tubes (i.e. toothpaste, hair products, detergents, and the like). The non-removable bottle closures may also be of particular use in the storage of toxic or reactive substances where bottle reuse should be discouraged.

Figure 6:
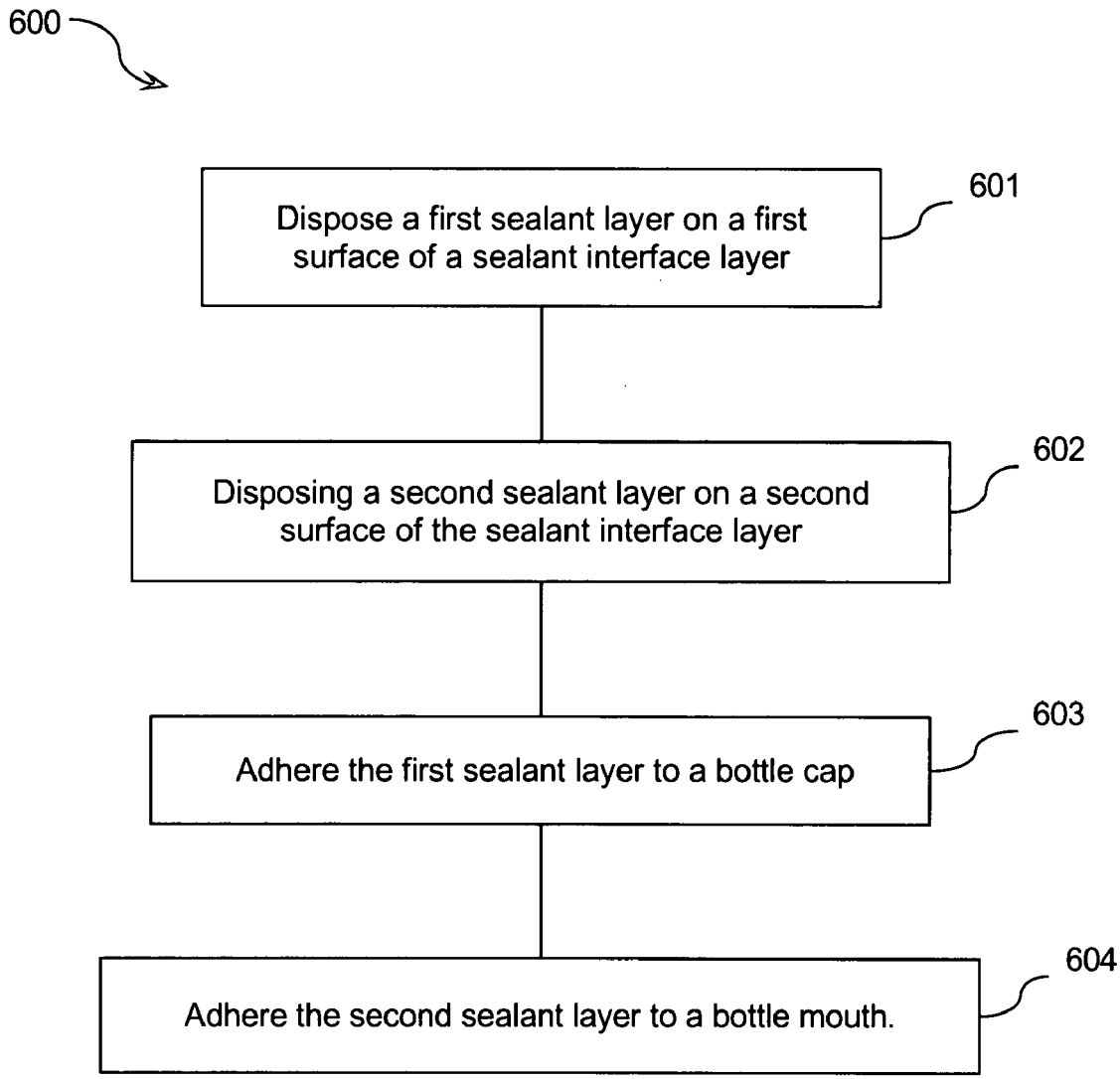
FIG. 6 depicts a process flowchart detailing a method for manufacturing a non-removable bottle closure in accordance with an embodiment of the present invention.

In FIG. 6, a flowchart detailing a method 600 for a manufacturing a non-removable bottle closure is presented. A first sealant layer is disposed on a first surface of a sealant interface layer at step 601. A second sealant layer is disposed on a second surface of the sealant interface layer at step 602. The first sealant layer is adhered to a bottle cap at step 603. The second sealant layer is adhered to a bottle mouth at step 604. As previously stated, the mechanism for adhering the sealant layers to the bottle cap and bottle mouth may comprise any such methods common to the art, including induction sealing.

It is believed that the present invention and many of its attendant advantages will be understood from the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A non-refillable receptacle for flowable materials, the receptacle comprising:

a non-refillable container having a mouth;

a non-removable closure including a dispensing aperture;

a bonding seal disposed between the non-refillable container and the non-removable closure, the bonding seal comprising:

a sealant interface layer, a first sealant layer bonding the non-removable closure to the sealant interface layer, a second sealant layer bonding the mouth of the container to the sealant interface layer, a first dispensing aperture disposed within the first sealant layer, a second dispensing aperture disposed within the sealant interface layer, and a third dispensing aperture disposed within the second sealant layer, wherein the first, second, and third dispensing apertures are cooperatively aligned to provide an open fluid dispensing conduit from the container mouth through the bonding seal; and wherein the non-removable closure is conjoined to the bonding seal to make the closure non-removable and the mouth of the container is conjoined to the bonding seal to make the container non-refillable.

2. The non-refillable receptacle of claim 1, wherein the container is at least one member of a group comprising: a condiment container, an alcoholic beverage container, a personal products container, a motor oil container, a toothpaste container, a hair product container, a detergent container, a toxic substance container, a reactive substance container, a bottle container and a squeezable tube container.

3. The non-refillable receptacle of claim 1, wherein the sealant interface layer includes at least one member of a group comprising: paper, foil and plastic.

4. The non-refillable receptacle of claim 1, wherein the sealant interface layer is surface treated via at least one member of a group comprising: abrading, roughening, acid etching, flame treating, plasma treating, thermal treating, and primer treating.

5. The non-refillable receptacle of claim 1, wherein the first sealant layer includes at least one member of a group comprising: polypropylene, polyethylene, high density polyethylene, low density polyethylene.

6. The non-refillable receptacle of claim 1, wherein the second sealant layer includes at least one member of a group comprising: polypropylene, polyethylene, high density polyethylene, low density polyethylene.

7. The non-refillable receptacle of claim 1, wherein the non-removable closure is induction sealed to the bonding seal.

8. The non-refillable receptacle of claim 1, wherein the mouth of the container is induction sealed to the bonding seal.

9. The non-refillable receptacle of claim 1, wherein the mouth of the container includes a flange, wherein the non-removable closure includes a recessed groove, wherein the flange snap-locks into the recessed groove.

10. The non-refillable receptacle of claim 1, wherein the mouth of the container includes a recessed groove, wherein the non-removable closure includes a flange, wherein the flange snap-locks into the recessed groove.

11. The non-refillable receptacle of claim, 1, further comprising a hermetic seal positioned over the dispensing aperture.

12. The non-refillable receptacle of claim 1, wherein the dispensing aperture is at least one member of a group comprising: centrally oriented on the non-removable closure, and non-centrally oriented on the non-removable closure.

13. The non-refillable receptacle of claim 1, wherein the non-removable closure includes a plurality of dispensing apertures.

14. The non-refillable receptacle of claim 1, further comprising a screw top lid removably securable to the non-removable closure.

15. The non-refillable receptacle of claim 1, further comprising a flip-top lid hingedly secured to the non-removable closure.

16. The non-refillable receptacle of claim of claim 1, wherein the sealant interface layer includes food safe plastic.

17. The non-refillable receptacle of claim 16, wherein the food safe plastic includes at least one member of a group comprising: polypropylene, high density polyethylene, low density polyethylene, and high-impact polystyrene.

18. The non-refillable receptacle of claim 1, wherein the mouth of the container includes threading, wherein the non-removable closure includes threading, wherein the treading of the container and the treading of the non-removable closure cooperate to secure the non-removable closure to the container mouth.

19. The non-refillable receptacle of claim 18, wherein the threading of the container is a reverse threading.

20. The non-refillable receptacle of claim 18, wherein the threading of the non-removable closure is a reverse threading.

* * * * *